United States Patent [19]

Otts

[11] 4,280,312

[45] Jul. 28, 1981

[54] APPARATUS FOR INSTALLING STRIPS OF MATERIAL TO SUPPORT ELEMENTS OF A BUILDING

[76] Inventor: Charles Otts, Box 358, DeQueen, Ark. 71832

[21] Appl. No.: 119,398

[22] Filed: Feb. 7, 1980

[51] Int. Cl.[3] ..... E04D 15/00

[52] U.S. Cl. ..... 52/749; 52/404; 52/743; 227/13; 227/111

[58] Field of Search ..... 52/749, 743, 747, 748; 173/31; 227/12, 13, 111

[56] References Cited

U.S. PATENT DOCUMENTS

| | | | |
|---|---|---|---|
| 3,310,215 | 3/1967 | Bostick | 227/12 |
| 3,969,863 | 7/1976 | Alderman | 52/743 |
| 3,992,847 | 11/1976 | Heath | 52/743 |
| 4,078,355 | 3/1978 | Clemensen | 52/749 |
| 4,222,212 | 9/1980 | Alderman | 52/749 |

FOREIGN PATENT DOCUMENTS

| | | | |
|---|---|---|---|
| 2003214 | 8/1978 | United Kingdom | 52/749 |

*Primary Examiner*—John E. Murtach
*Assistant Examiner*—Henry E. Raduazo
*Attorney, Agent, or Firm*—Burns, Doane, Swecker & Mathis

[57] ABSTRACT

An insulation installing implement is manually operable by means of an elongated handle, and is positionable between wall studs or ceiling joists to hold, feed and anchor opposite selvage edges of an insulation blanket against a pair of spaced apart studs or ceiling joists by remote manual control operation of a pair of anchoring devices carried by the frame of the implement.

20 Claims, 15 Drawing Figures

Fig. 5
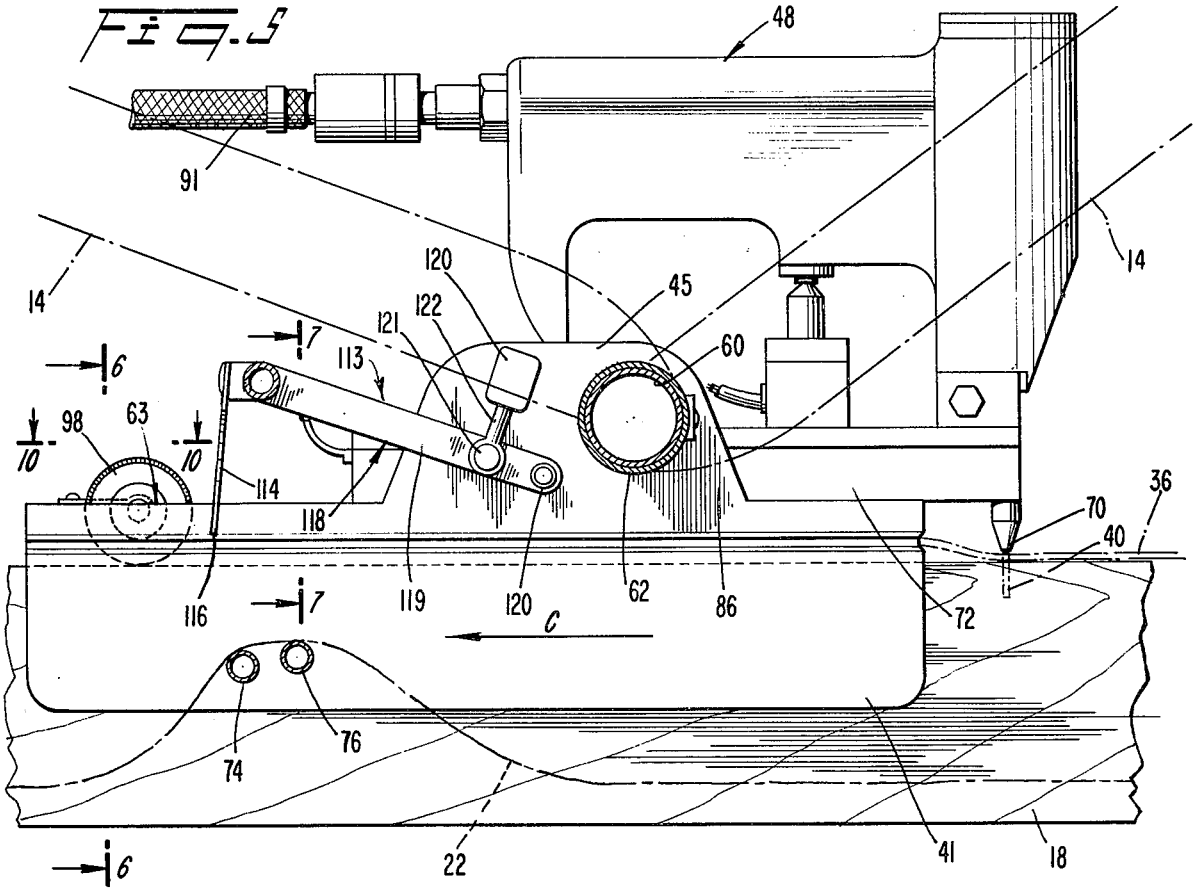
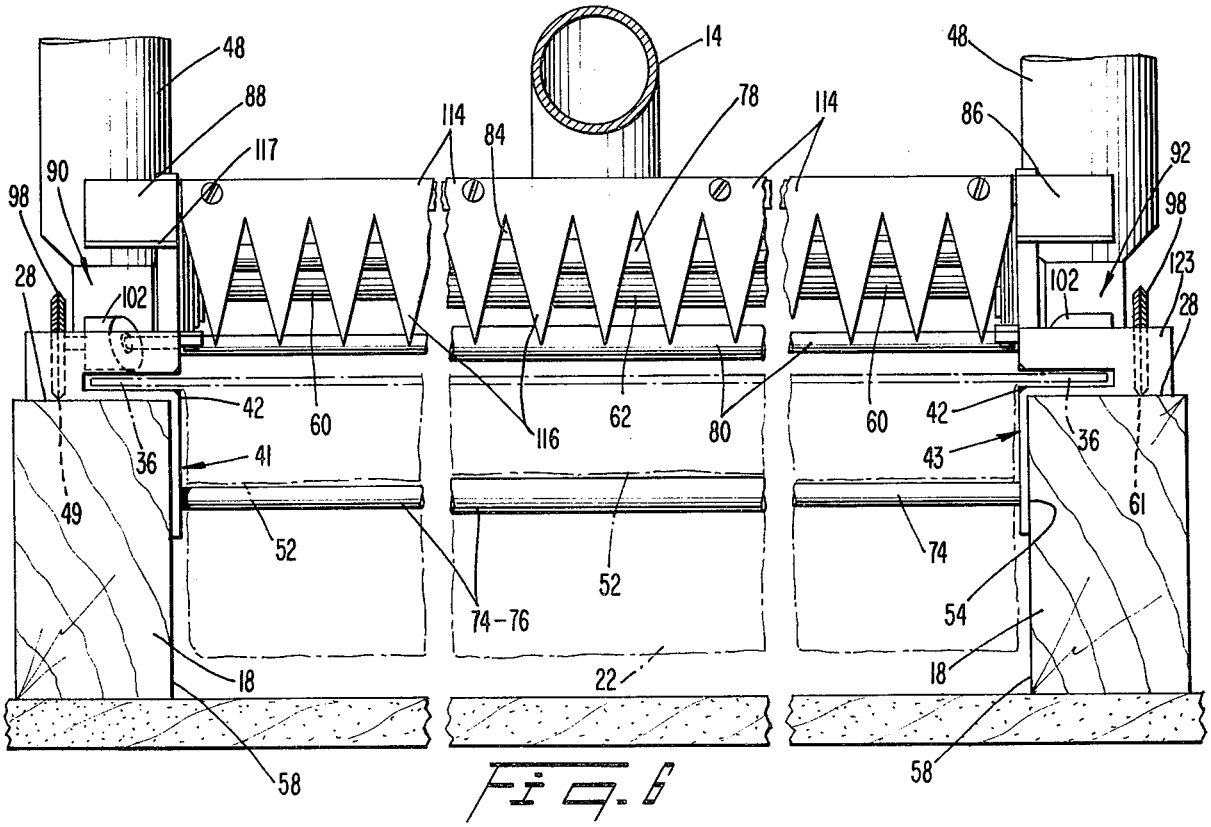
Fig. 6

APPARATUS FOR INSTALLING STRIPS OF MATERIAL TO SUPPORT ELEMENTS OF A BUILDING

BACKGROUND AND OBJECTS OF THE INVENTION

The present invention relates to the installation of strips of material, especially blankets of insulation between spaced support elements of a building.

Tradesmen have heretofore encountered considerable difficulty in the installation of strips of material such as insulation blankets between the wall studs and ceiling joists of a building. In many instances, the tradesmen must operate on scaffolds, stilts or ladders and a great amount of time is spent in anchoring the upper salvage edges of the blanket to opposed studs. Additionally, maintaining the alignment of the selvage edges with the studs and avoiding wrinkling of the selvage edges has been a considerable problem.

Tensioning of the selvage edges away from each other to hold the blanket taut further causes the tradesmen to expend a considerable amount of time. Consequently, manual installation of blanket insulation has been quite costly.

In many instances, poor alignment and wrinkling of the selvage edges occurs. The wrinkles cause considerable difficulty in the later installation of sheet rock, paneling or ceiling tile or other surface materials generally placed over the insulation blankets when finishing walls or ceilings. Any wrinkles in the selvage edges cause the wall or ceiling finish material to be uneven. In many instances, considerable costs are incurred in removing the wall finish material as well as the insulation blanket in order to correct the improper installations.

Therefore, it is an object of the present invention to minimize or eliminate problems of the above-noted type.

It is another object of the invention to provide an efficient, manually operable device for use in rapidly installing insulation blankets between building room wall studs or ceiling joists.

Another object of the invention is to provide a novel insulation blanket installing device which may be operated manually by an operator standing on the floor of a room without the need for stilts, ladders or scaffolds.

A further object of the invention is to provide a novel insulation blanket installing device having tensioning means which engage opposite selvage edges of an insulation blanket for creating taut conditions thereof and straight unwrinkled condition of the selvage edges at a location over or adjacent to studs, whereupon staple drivers or anchoring devices secure the selvage edges in a straight, unwrinkled condition to said studs.

Another object of the invention is to provide a novel insulation blanket installing device which maintains a continuous feed from a roll of insulation blanket material during successive installation operations carried out between a pair of studs and the next adjacent pair of studs.

Another object of the invention is to provide a machine for installing insulation which may be operated by inexperienced personnel and which provides for an accurate and efficient installation of insulation material between studs or ceiling joists.

Another object of the invention is to provide an insulation installing device which provides for threading of the insulation blanket through channels in the stud runners so that the machine may be raised into position in between the studs with the device being moved along the studs and adaptable to changes in the spacing between the studs, due to improper dimensioning or warpage.

Further objects and advantages of the invention may be apparent from the following specification, appended claims, and accompanying drawings.

BRIEF SUMMARY OF THE INVENTION

These and other objects are achieved by the present invention involving apparatus for securing a strip of material to spaced support members of a building. The apparatus comprises a control head including runners for traveling along the support members to align the control head relative to the support members. Opposite edges of the strip of material are guidingly received in the control head, with the control head being movable relative to the strip of material while positioning the edges thereof adjacent the support members. A securing mechanism secures the edges to the support members as the control head travels therealong. A handle is connected at one end to the control head and is operable to be held at the opposite end by an operator to manually displace the control head along the support members while securing the strip of material thereto.

BRIEF SUMMARY OF THE DRAWINGS

FIG. 5 is a side elevational view of the implement taken along the line 5—5 of FIG. 3;

FIG. 6 is an end view of the implement taken along the line 6—6 of FIG. 5;

DETAILED DESCRIPTION OF PREFERRED EMBODIMENTS OF THE INVENTION

An implement 10 according to the present invention is adapted to secure strips of material, such as insulation and building paper for example, to spaced support elements of a building, such as wall studs or ceiling joists. In the following description the invention will be described in relation to the installation of insulation.

Figure 1:
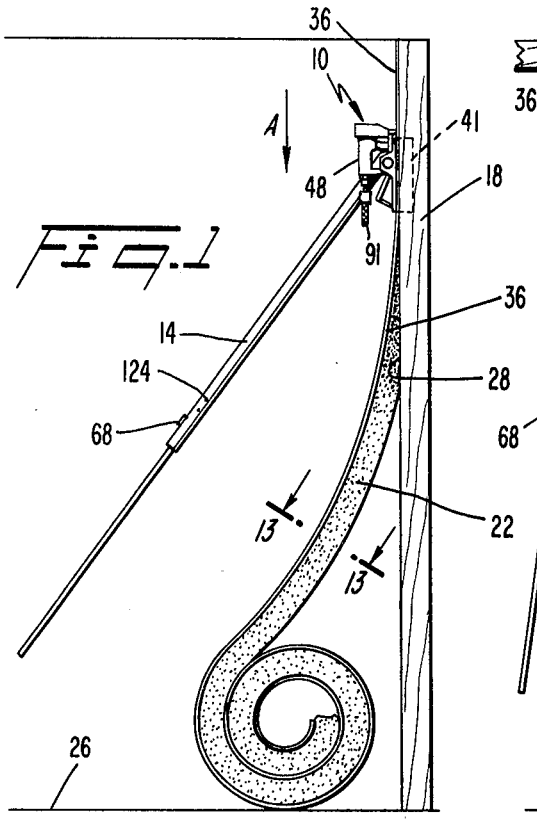
FIG. 1 is a side elevational view of the insulation blanket installing implement of the present invention shown holding a portion of a rolled insulation blanket, and disposed adjacent the ceiling of a room and operable in a downward direction for installing and stapling or anchoring insulation blanket between a pair of wall studs.
Figure 2:
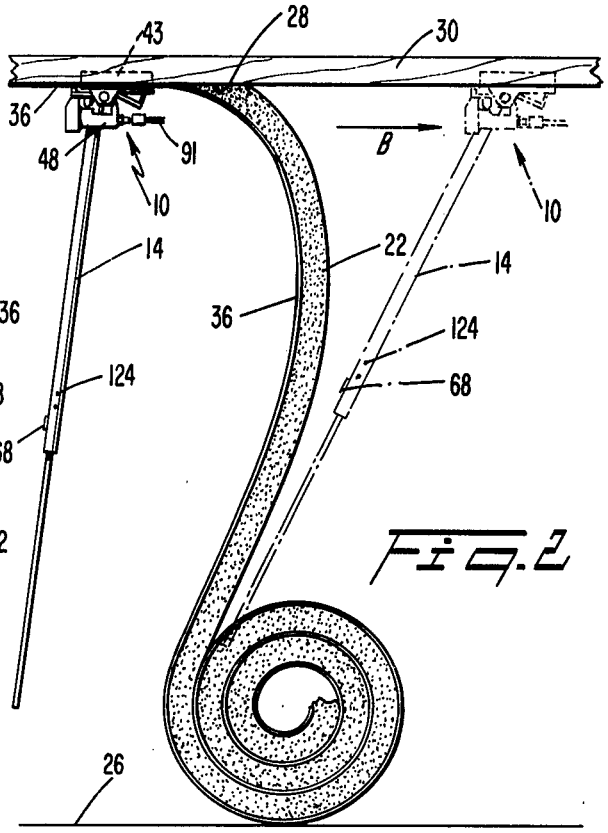
FIG. 2 is a view similar to FIG. 1 showing the implement of the invention installing insulation blanket material from a roll onto the edges of ceiling joists, with the broken lines showing the progression of the implement as well as the blanket from one position to another horizontally along said ceiling joists.
Figure 3:
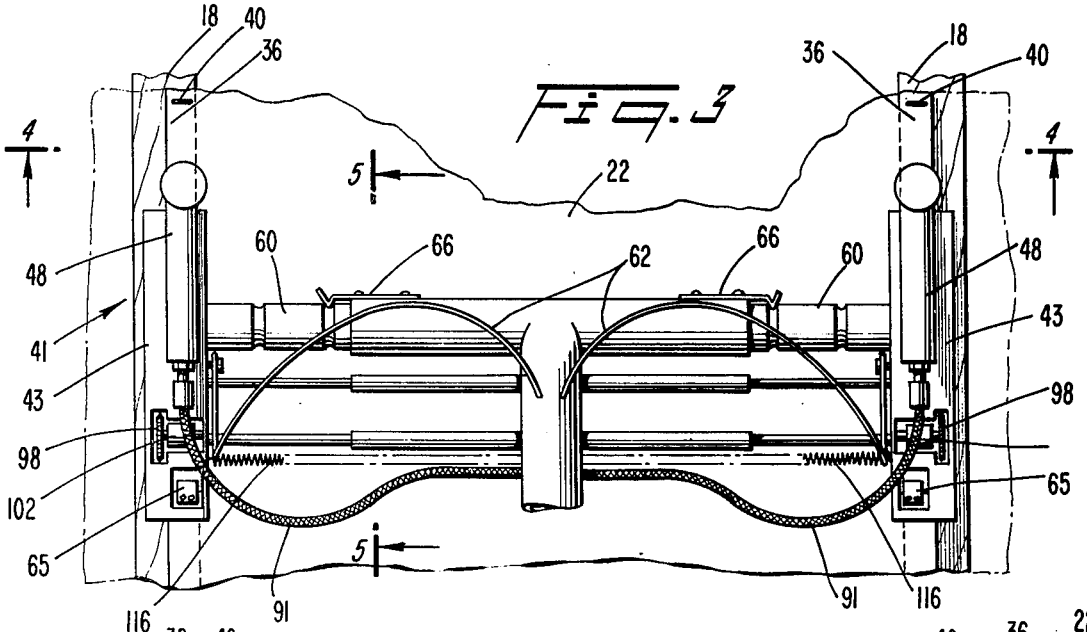
FIG. 3 is an enlarged, fragmentary side view of the implement of the present invention showing the installation of an insulation blanket between a pair of spaced apart wall studs.

The implement 10 is depicted in FIG. 1 as installing an insulation blanket 22 between vertical wall studs 18 and is depicted in FIG. 2 as installing an insulation blanket 22 between horizontal ceiling joists 30. In both instances it is merely necessary for an operator to stand upon the floor 26 and maneuver a handle portion 14 of the implement. As will be discussed, the implement functions to properly position the insulation blanket and anchor it in place.

The implement 10 comprises a control head 12 pivotably attached to one end of the handle 14. The handle 14 is preferably three to nine feet in length and may be of a telescoping nature to be rendered compact. The head 12 comprises a pair of stud runners 41, 43 each including an upstanding ear 45 (FIG. 5). Rigidly connected to the ears 45 are a pair of rods 60 which are telescopingly received in a hollow bar 62 of the handle 14.

A pair of spring locks 66 are mounted on the bar 62 and are releasably receivable in annular grooves 64 in the rods 60 to hold the rods in selected positions of adjustment. In this fashion, the spacing between the runners can be varied to adapt the implement to different stud or joist spacings. Also, the handle 14 can be rotated relative to the rods 60 about an axis defined by the bar 62.

The runners 41, 43 each include a base portion 47 and a depending flange portion 52. Each base portion 47 includes a surface 49 adapted to travel against a front surface 28 of the stud or joist. Each flange 52 includes a surface 54 adapted to travel against a side surface 58 of the stud or joist. In this fashion, the control head 12 is kept in proper alignment relative to the studs or joists.

Each base portion 47 includes a guide channel 42 which lies generally parallel to the surface 49 and is open laterally inwardly such that the open ends of the channels 42 face one another.

As will be discussed, the channels 42 are adapted to receive opposite selvage edges 36 of the backing or vapor barrier portion of the insulation blanket.

Figure 10:
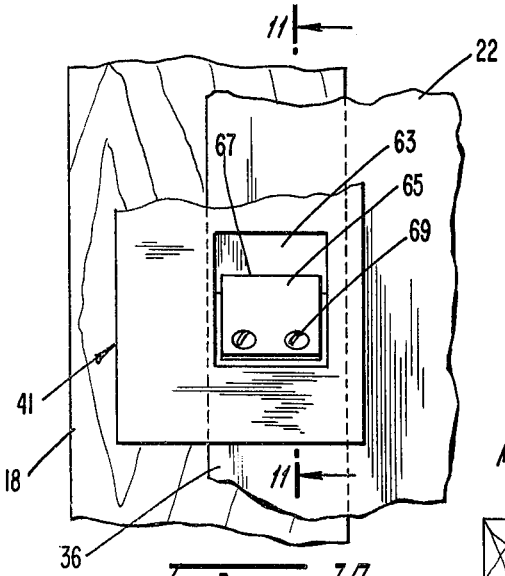
FIG. 10 is an enlarged fragmentary view taken along the line 10—10 of FIG. 5.
Figure 11:
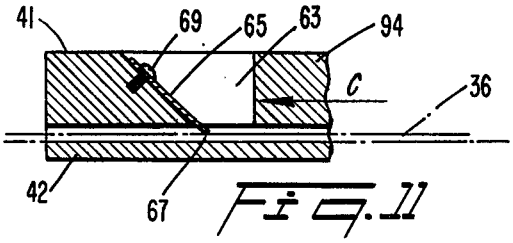
FIG. 11 is an enlarged fragmentary sectional view taken along the line 11—11 of FIG. 10.

Each of the runners 41, 43 includes an aperture 63 at a front end thereof (FIGS. 10–11) which open into the associated channel 42. A resilient dog 65 in the form of a flat plate is secured by screws 69 within the aperture 63 so as to be directed rearwardly and downwardly. The dog 65 includes an edge 67 located within the channel, which edge is engageable with an associated selvage edge 36. The dog 65 functions to permit relative travel between the head 12 and the insulation blanket 22 in one direction only. That is, the head 12 may travel forwardly (i.e., in direction C in FIGS. 5 and 11) relative to the blanket 22. Hence, once the blanket 22 is threaded into the channels 42 it will be gripped by the dogs 65 until an end of the blanket has been anchored.

Interconnected between the runners is an insulation support structure in the form of two pairs of telescoping rod assemblies 74, 76 (FIG. 5). The rod assemblies 74, 76 are connected between the flanges 52, 54 of the respective runners 41, 43, and are positioned just rearwardly of tensioning devices to be described hereafter. The rod assemblies 74, 76 are spaced below the channels 42 by a distance less than the thermal thickness of the insulation blanket 22. During operation of the implement, the selvage edges of the blanket will be disposed in the channels 42 and the blanket will extend over the telescoping bar assemblies 74, 76. In this fashion, the blanket will be slightly compressed, assuring that the selvage edges 36 are pressed into the channels 42. This assures that the edges will be properly disposed for being secured to the studs or joists.

Mounted on each of the runners is a blanket anchoring mechanism which may take various forms such as a glue applicator, for example, but preferably comprises a fastener dispenser such as a conventional staple driver 48. The staple driver can be of the electrically, pneumatically, or mechanically operated type and is capable of remote control by the operator. Such a staple driver is manufactured by the Bostich Company of Greenwich, R.I.

The staple driver 48 is mounted on the associated runner by means of a bracket 72 and is positioned such that a staple driving head 70 of the staple driver extends rearwardly of the runner and is positioned to drive staples through the selvage edges 36 of the insulation blanket and into the front surface 28 of the ceiling joist or wall stud.

If an electrically actuated staple driver is employed, an actuating button 68 is provided on the handle 14 to activate the driving head by means of an electrical cable 91 (FIG. 5). An electric cord of such driver can be connected to any suitable source of electric power.

Figure 7:
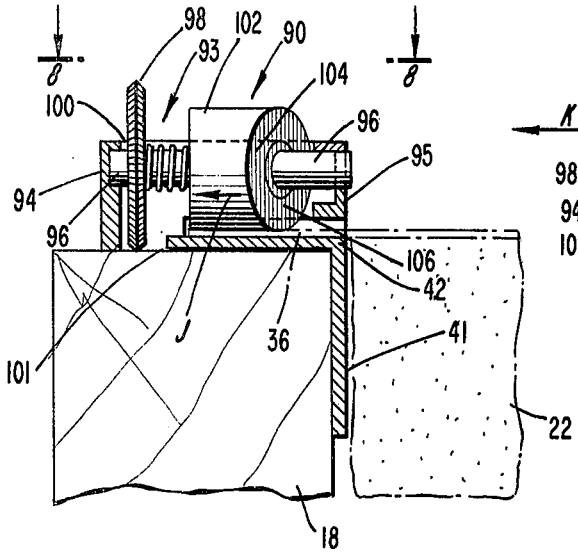
FIG. 7 is a fragmentary sectional view taken along the line 7—7 of FIG. 5 showing the tensioning means of the invention and the unfolding of the selvage edge from the insulation blanket, and the disposition of the selvage edge in the guide channel structure adjacent to tensioning means.
Figure 8:
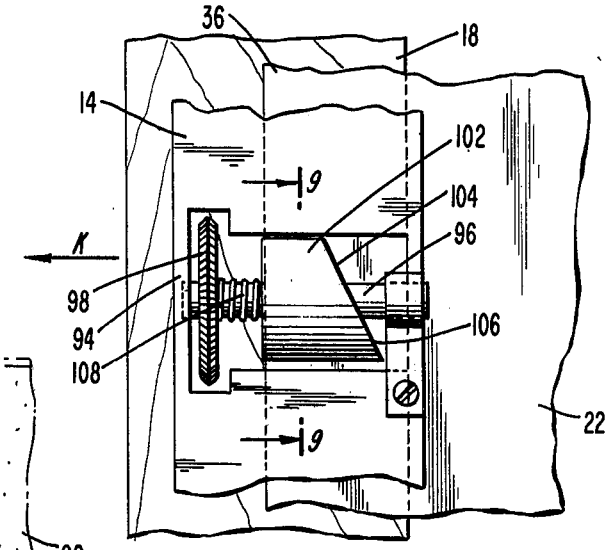
FIG. 8 is a fragmentary sectional view taken along the line 8—8 of FIG. 7.

The runners 41, 43 may, if desired, be provided with selvage edge tensioning devices 90, 92. These devices are similar and therefore a description of one of the tensioning devices 90 as follows will be considered to define both of the devices 90 and 92. The tensioning device 93, shown in FIGS. 6, 7, 8 and 9 is disposed in a recess 91 in the runner and includes a shaft 96. The shaft 96 is rotatably mounted in portions 94, 95 of the runner (FIG. 7). A stud engaging wheel 98 is mounted on the shaft 96 and includes a serrated periphery 100 which frictionally engages the top surface 101 of a stud 18, as shown in FIG. 7, and frictionally drives the shaft 96 to rotate a selvage edge-engaging roller 102 which is mounted on the shaft 96. One end of the roller 102 is provided with a cam surface 104 which engages a stationary cam 106 carried by the runner portion 95. A spring 108 is disposed between the wheel 98 and the roller 102 to urge the roller 102 toward the cam 106, so that as the stud engaging wheel 98 rotates the roller 102, the cam surface 104 traverses the stationary cam 106 and causes the roller 102 to reciprocate along the axis of the shaft 96 in the direction of the arrow J in FIG. 7.

Figure 9:
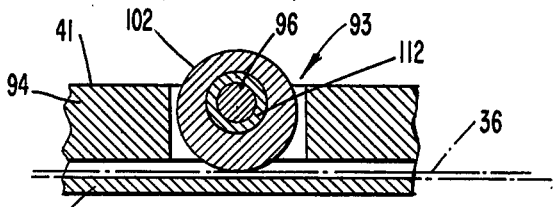
FIG. 9 is a fragmentary sectional view taken along the line 9—9 of FIG. 5.

As shown in FIG. 9 of the drawings, the roller 102 is provided with a peripheral surface 110 which is eccentric to the shaft 96. A key 112 is received within a slot in the shaft 96 to allow the roller 102 to move axially relative to the shaft while being rotatably driven by the wheel 98.

The eccentric peripheral surface 110 of the roller 102 is engageable with the respective selvage edge 36 in the channel 42 when the roller 102 is in such position relative to the cam 106 that the roller 102 is about to be pushed outwardly (direction K) by the cam 106 (i.e., toward the wheel 98 in FIG. 7). Accordingly, the selvage edge 36 is urged outwardly. Simultaneously, the roller 102 of the other tensioning device 92 urges its associated selvage edge outwardly. Accordingly, the insulation blanket is laterally tensioned and smoothed.

Eventually, the roller 102 rotates such that the eccentric peripheral surface 110 moves out of engagement with the selvage edge 36, whereupon the cam 106 allows the roller 102 to be shifted inwardly by the spring 108.

It will be appreciated that the tensioning devices 90, 92 serve to maintain the selvage edges 36 taut thereby facilitating proper stapling of the edges.

The control head includes a cutting mechanism 113 which comprises a cutter blade 114 secured to a swingable bracket 118. The bracket 118 includes a pair of arms 119 each pivotally mounted to a runner 41, 43 by a pivot pin 120. A pair of brace bars 121 extend between the arms 119 for support. The cutter blade 114 is rigidly mounted at the ends of the arms 119 and extends laterally from one runner 41 to the other 43. The blade 114 includes a serrated cutting edge 116. A pair of electric solenoid type actuators 120 are pivotably mounted on the runners 41, 43 and each include an extendable rod 122 pivotably connected to the arms 119. The solenoids 120 can be connected to any suitable source of electricity by the cord 93. A button-type actuator 124 on the handle enables the operator to activate the solenoids to extend the rods 122 and thereby depress the cutter knife through the insulation blanket 22 to sever the latter. The knife 114 is arranged to travel between the rod assemblies 74, 76 to assure that the insulation blanket 22 is firmly supported to facilitate cutting.

Of course other types of cutter mechanisms 113 could by employed which are mechanically or fluidly actuated.

Figure 13:
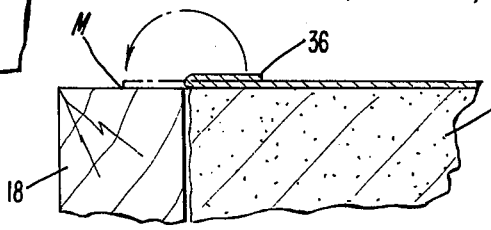
FIG. 13 is a cross-sectional view of an insulation blanket showing the selvage edge in a folded position and showing by broken lines the unfolded position and the installation of the blanket onto the edge of a wall stud.
Figure 12:
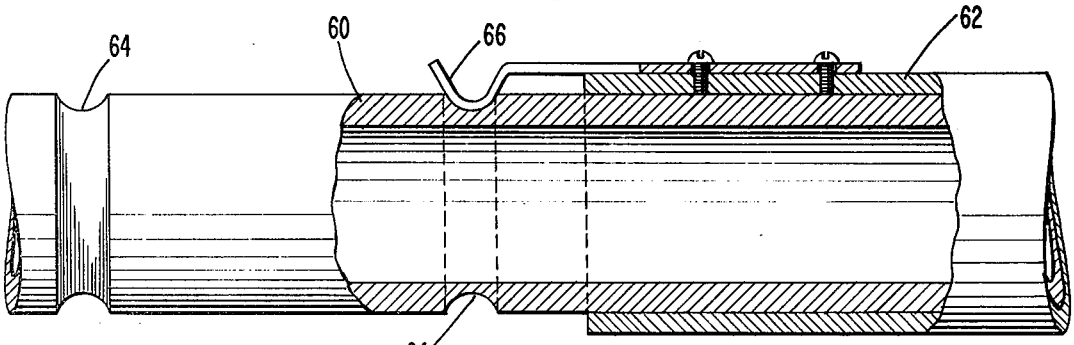
FIG. 12 is a fragmentary elevational view of the telescopic extendable bars and the stud runners of the frame of the invention.

During OPERATION for installing insulation between wall studs 18, the implement 10 is in the position as shown in FIG. 1 with the selvage edges 36 fed forward to a position adjacent the driving portion 70 of the staple guns. The button actuator 68 is then depressed, causing the staplers to drive staples 40 through the edges 36 and into the front surfaces 28 of the studs to anchor the upper end of the blanket 22 in place. The control head 12 is thereafter moved downwardly along the studs relative to the blanket by manual manipulation of the handle 14. As the control head is moved downwardly, the channels 42 receive further portions of the insulation edges 36 and function to unfold the selvage edges from the usual folded position shown in solid lines in FIG. 13 to the broken line unfolded position M. Therefore, the implement 10 automatically unfolds the selvage edges to a position overlying the studs. The blanket 22 is slightly compressed while traveling over the rod assemblies 74, 76 to cause the edges 36 to be pushed into the channels 42.

Figure 4:
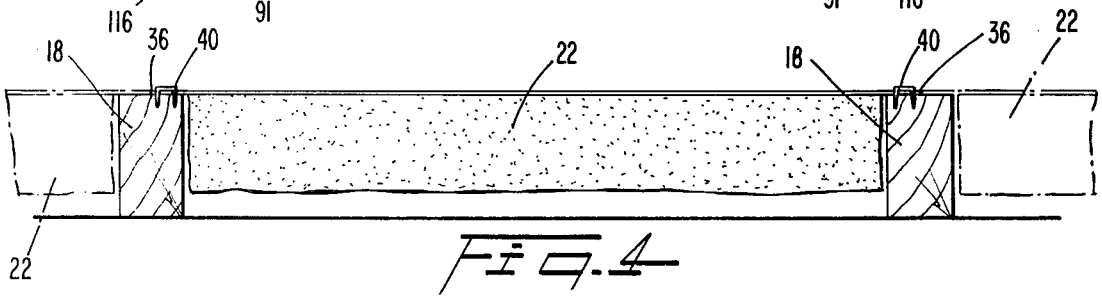
FIG. 4 is a sectional view taken along the line 4—4 of FIG. 3 showing an insulation blanket material installed between the wall studs as shown in FIG. 3 of the drawings.

The operator periodically pushes the actuator button 68 on the handle 14 to activate the staplers 48 and the drive staples 40 through the edges 36 and into the front surfaces 28 of the studs (FIG. 4).

When the control head 12 reaches the floor 26, the handle 126 is actuated, causing the cutter blade 114 to cut the blanket. The control head 12 is then moved relative to the installed blanket to remove the edges of the latter from the channels 42. The last eighteen inches, or so, of the insulation can be stapled by hand.

Meanwhile, the front end of the non-installed portion of the installation remains secured within the channels 42 by the dogs 65. It is then merely necessary to pull such front end completely through the channels 42 to insulate a new section.

To install insulation between ceiling joists 30, a similar operation takes place, except that the control head 12 travels horizontally rather than vertically. If desired, the insulation can be applied from one side of the ceiling to the center and then from the other side of the ceiling back to the center to eliminate the need for manually securing the last eighteen inches of the insulation.

In lieu of the rod assemblies 74, 76, a plate can be provided which is connected between the runners and extends along at least a substantial portion of the fore-aft length of the runners at about the same height as the rod assemblies 74, 76. Thus, the bottom of the insulation would rest on the plate and the selvage edges would be pushed into the respective channels 42 along substantially the entire length of the latter. Such an arrangement could eliminate the need for the tensioner devices 90, 92. The dog 65 or its equivalent could be disposed on such a plate if desired. As regards the cutter knife 114, a slot would be provided in the plate to receive the knife 114 during a cutting thrust. If such a plate is utilized, it may also be desirable to eliminate the adjustable bar assembly 60, 62 and replace it by a frame which is detachably fastened to the runners 41, 43 and is pivotably attached to the handle. The staple driver 48 and cutter knife assembly 113 would be detachably mountable to such a frame. In order to adapt the control head to different stud or joist spacings, a selection of differently sized frames could be provided which are interchangeable. The staple drive and cutter knife, and any other necessary components, would be mountable on each of the frames.

It should be noted that as much of the control head 12 as possible should be formed of light-weight material such as aluminum to minimize the overall weight thereof and thereby facilitate maneuvering of the control head.

Figure 15:
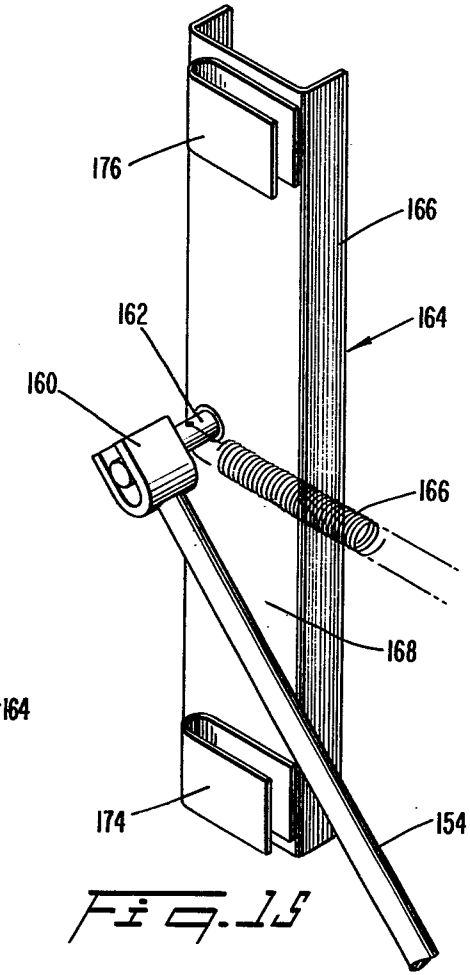
FIG. 15 is a perspective view of a portion of the implement depicted in FIG. 14.
Figure 14:
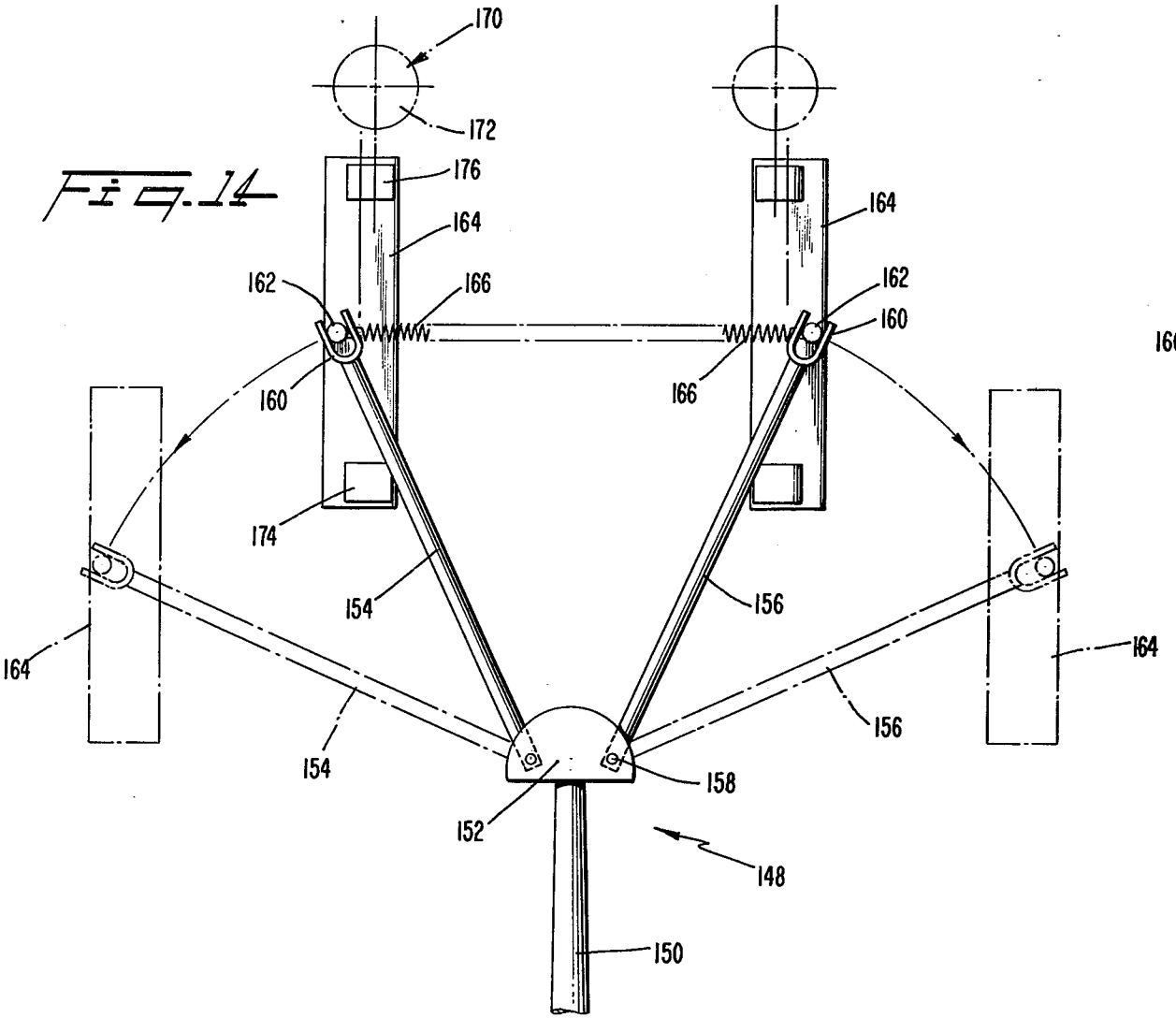
FIG. 14 is a plan view of an alternate form of the implement with the staple driver omitted for clarity.

An alternate embodiment of an implement 148 is disclosed in connection with FIGS. 14 and 15, wherein a handle 150 carries at its outer end a plate 152. A pair of arms 154, 156 are pivotably connected to the plate 152 by pivot pins 158 so as to be swingable towards and away from one another to adapt to varying spacing between adjacent joists or studs.

The outer ends of the arms 154, 156 are shaped as yokes 160 and are pivotably connected to pins 162 projecting from stud runners 164.

A spring 166 interconnects the pins 162 to bias the stud runners toward one another.

The pins 162 are rotatably mounted to the stud runners to accommodate swinging of the arms 154, 156 while the stud runners remain oriented parallel to the studs.

The stud runners 164 are each of the U-shape and include legs 166 which straddle the stud, and a bight portion 168 on which a staple driver 170 is mounted.

The staple driver 170 can be mounted in any suitable fashion on the stud runners as long as the head 172 of each staple driver is positioned rearwardly of the stud runners.

A pair of brackets 174, 176 are mounted on the front and rear ends of the bight portion 168 of each stud runner 164. The brackets on one runner are open towards those on the other runner and function in a manner similar to the guide channels 42 to receive and unfold the selvage edges of the insulation. Operation of the implement 148 is similar to that of the earlier described implement 10 and need not be further discussed, except to again point out that the swingable nature of the mounting arms 154, 156 enables the implement to automatically adjust to the spacing between adjacent joists or studs.

It will be appreciated that the present invention enables strips of material such as insulation to be installed with minimal effort and to considerable heights without the need for scaffolding or ladders. Considerably less time and effor need thus be expended.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Apparatus for securing a strip of material between spaced support members of a building, comprising:

a control head including runner means for traveling along said support members to align said control head relative to said support members, means for guidingly receiving opposite edges of said strip of material and permitting movement of said control head relative to said strip of material while positioning said edges adjacent said support members, securing means for securing said edges to said support members as said control head travels therealong; and a handle connected at one end to said control head and operable to be held at the opposite end by an operator to manually displace said control head along said support members while said strip of material is being secured thereto.

2. Apparatus according to claim 1, wherein control head includes means engaging said edges for resisting movement of said control head relative to said strip of material in one direction while permitting such relative movement in the opposite direction.

3. Apparatus according to claim 1, wherein said runner means comprises a pair of runners which are adjustable toward and away from one another to adapt said runners to support elements of different spacing.

4. Apparatus according to claim 3, wherein said runners are freely movable toward and away from one another.

5. Apparatus according to claim 4, including spring means urging said runners toward one another.

6. Apparatus according to claim 1, wherein said receiving means comprises a pair of channels which receive said edges, said control head further including support means for engaging an underside of said strip of material and urging said edges into said channels.

7. Apparatus according to claim 1, wherein said control head includes tensioning means for urging said edges laterally apart to render said strip of material taut.

8. Apparatus according to claim 1, wherein said runner means comprises a pair of runners, each runner including a base portion operable to slide along a front surface of a respective support member and a depending flange operable to slide along a side surface of said respective support member.

9. Apparatus according to claim 1, wherein said control head includes a cutter blade displaceable for severing said strip of material, means for displacing said cutter blade, and means accessible at said opposite end of said handle for actuating said blade displacing means.

10. Apparatus according to claim 1, wherein said handle is at least four feet long.

11. Apparatus according to claim 1, wherein said securing means comprises a staple driver, and means accessible at said opposite end of said handle for actuating said staple driver.

12. Apparatus for securing a strip of material to spaced apart support members of a building, comprising:

a control head including:

a pair of laterally spaced runners operable to travel longitudinally along said support members, said runners including inwardly open, longitudinally extending guide channels for receiving opposite edges of said strip of material, a fastener dispenser mounted on each of said runners and being arranged to insert a fastener through a respective one of said edges and into the associated support member, and a handle at least four feet in length pivotably connected at one of its ends to said control head and operable to be gripped by an operator at the other of its ends for manual displacement of said control head along said support members and relative to said strip of material as said securing means secures said edges thereto.

13. Apparatus according to claim 12, wherein said control head includes means engaging said edges for resisting movement of said control head relative to said strip of material in one direction while permitting such relative movement in the opposite direction.

14. Apparatus according to claim 12, wherein said control head includes tensioning means for urging said edges laterally apart to render said strip of material taut.

15. Apparatus according to claim 12, wherein each runner includes a base portion operable to slide along a front surface of a respective support member and a depending flange operable to slide along a side surface of said respective support member.

16. Apparatus according to claim 12, wherein said control head includes a cutter blade displaceable for severing said strip of material, means for displacing said cutter blade, and means accessible at said opposite end of said handle for actuating said blade displacing means.

17. Apparatus according to claim 12, wherein said fastener dispenser comprises a staple driver and means accessible from said other end of said handle for actuating said staple driver.

18. Apparatus according to claim 12, wherein said runners are adjustable toward and away from one another.

19. Apparatus according to claim 18, wherein said runners are freely movable toward and away from one another and are biased toward one another by a spring.

20. Apparatus for securing strips of insulation to spaced apart support members of a building, said insulation being of the type comprising a backing sheet with outside edges, said apparatus comprising:

a control head including:

a pair of spaced apart runners, each runner including:

a base portion adapted to slide along a front surface of an associated support member, a depending flange portion adapted to slide along a side surface of the associated support member, a guide channel disposed generally parallel to said top surface for slidably receiving one of said edges of said backing sheet to position said edge over said front surface of said support member, a fastener dispenser mounted on each runner and positioned to drive a fastener through a respective edge of said backing sheet and into said front surface of said support member, a cutting mechanism for cutting the insulation, a handle at least four feet in length pivotably secured at one of its ends to said control head and operable to be gripped at another of its ends by an operator to manually displace said control head along said support members, and manual actuating means at said other end of said handle and operably connected to said fastener dispenser and said cutting mechanism to enable the operator to selectively actuate said fastener dispenser and said cutting mechanism.

* * * * *